US007837510B1

(12) United States Patent
Hung et al.

(10) Patent No.: US 7,837,510 B1
(45) Date of Patent: Nov. 23, 2010

(54) ELECTRICAL CONNECTOR WITH IMPROVED CONTACT ARRANGEMENT

(75) Inventors: Yung-Chih Hung, Jhonghe (TW); Yong-Gang Zhang, Taicang (CN); Hung-Chi Tai, Jhonghe (TW)

(73) Assignee: Alltop Electronics (Suzhou) Co., Ltd, Taicang, Jiangsu Province (CN)

( * ) Notice: Subject to any disclaimer, the term of this patent is extended or adjusted under 35 U.S.C. 154(b) by 0 days.

(21) Appl. No.: 12/508,105

(22) Filed: Jul. 23, 2009

(30) Foreign Application Priority Data

May 20, 2009 (CN) ..... 2009 2 0156313

(51) Int. Cl.
*H01R 24/00* (2006.01)

(52) U.S. Cl. ..... 439/660; 439/924.1

(58) Field of Classification Search ..... 439/660, 439/924.1

See application file for complete search history.

(56) References Cited

U.S. PATENT DOCUMENTS

| | | | | |
|---|---|---|---|---|
| 7,021,971 | B2 | 4/2006 | Chou et al. | |
| 7,104,848 | B1 | 9/2006 | Chou et al. | |
| 7,134,884 | B2 | 11/2006 | Wang et al. | |
| 7,232,346 | B2 | 6/2007 | Hu et al. | |
| 7,371,116 | B2 * | 5/2008 | Chiang | 439/607.34 |
| 7,422,488 | B1 * | 9/2008 | Wu | 439/676 |
| 7,427,217 | B2 | 9/2008 | Chou et al. | |
| 7,442,051 | B2 | 10/2008 | Jiang et al. | |
| 7,625,243 | B2 * | 12/2009 | Chen et al. | 439/660 |
| 7,682,200 | B2 * | 3/2010 | Zheng et al. | 439/660 |
| 7,686,656 | B2 * | 3/2010 | Zheng et al. | 439/660 |
| 2006/0029427 | A1 | 2/2006 | Yoshizawa et al. | |
| 2008/0311801 | A1 | 12/2008 | Chen et al. | |
| 2009/0042420 | A1 | 2/2009 | Zheng et al. | |
| 2009/0042421 | A1 | 2/2009 | Zheng et al. | |
| 2009/0042450 | A1 | 2/2009 | Zheng et al. | |

* cited by examiner

*Primary Examiner*—Gary F. Paumen
(74) *Attorney, Agent, or Firm*—Sughrue Mion, PLLC

(57) ABSTRACT

An electrical connector includes an insulative housing extending in a front-to-back direction and including a rear base portion and a front tongue portion, and first and second sets of contacts held in the insulative housing. The first set of contacts includes at least one pair of differential contacts for transmitting high-speed signals. Each first contact includes a nonelastic first mating portion occupying a front section of the tongue portion. Each of the second set of contacts includes an elastic second mating portion located behind the nonelastic first mating portion along the front-to-back direction. The first and second sets of contacts are assembled to the insulative housing along opposite directions. The first and second body portions are provided with interference sections thereon to interferentially engage with the insulative housing. The first mating portion of each first contact is provided with interference sections to engage with the tongue portion of the insulative housing.

15 Claims, 8 Drawing Sheets

ELECTRICAL CONNECTOR WITH IMPROVED CONTACT ARRANGEMENT

BACKGROUND OF THE INVENTION

1. Field of the Invention

The present invention relates to an electrical connector, more particularly to an electrical connector compatible to standard Universal Serial Bus (USB) 2.0 connector.

2. Description of Related Art

Recently, personal computers (PC) are used of a variety of techniques for providing input and output. Universal Serial Bus (USB) is a serial bus standard to the PC architecture with a focus on computer telephony interface, consumer and productivity applications. The design of USB is standardized by the USB Implementers Forum (USB-IF), an industry standard body incorporating leading companies from the computer and electronic industries. USB can connect peripherals such as mouse devices, keyboards, PDAs, gamepads and joysticks, scanners, digital cameras, printers, external storage, networking components, etc. For many devices such as scanners and digital cameras, USB has become the standard connection method.

As of 2006, the USB specification was at version 2.0 (with revisions). The USB 2.0 specification was released in April 2000 and was standardized by the USB-IF at the end of 2001. Previous notable releases of the specification were 0.9, 1.0, and 1.1. Equipment conforming to any version of the standard will also work with devices designed to any previous specification (known as: backward compatibility).

USB supports three data rates: 1) A Low Speed rate of up to 1.5 Mbit/s (187.5 KB/s) that is mostly used for Human Interface Devices (HID) such as keyboards, mice, and joysticks; 2) A Full Speed rate of up to 12 Mbit/s (1.5 MB/s). Full Speed was the fastest rate before the USB 2.0 specification and many devices fall back to Full Speed. Full Speed devices divide the USB bandwidth between them in a first-come first-served basis and it is not uncommon to run out of bandwidth with several isochronous devices. All USB Hubs support Full Speed; 3) A Hi-Speed rate of up to 480 Mbit/s (60 MB/s). Though Hi-Speed devices are commonly referred to as "USB 2.0" and advertised as "up to 480 Mbit/s", not all USB 2.0 devices are Hi-Speed. Hi-Speed devices typically only operate at half of the full theoretical (60 MB/s) data throughput rate. Most Hi-Speed USB devices typically operate at much slower speeds, often about 3 MB/s overall, sometimes up to 10-20 MB/s. A data transmission rate at 20 MB/s is sufficient for some but not all applications. However, under a circumstance transmitting an audio or video file, which is always up to hundreds MB, even to 1 or 2 GB, currently transmission rate of USB is not sufficient. As a consequence, faster serial-bus interfaces are being introduced to address different requirements. PCI Express, at 2.5 GB/s, and SATA, at 1.5 GB/s and 3.0 GB/s, are two examples of High-Speed serial bus interfaces.

From an electrical standpoint, the higher data transfer rates of the non-USB protocols discussed above are highly desirable for certain applications. However, these non-USB protocols are not used as broadly as USB protocols. Many portable devices are equipped with USB connectors other than these non-USB connectors. One important reason is that these non-USB connectors contain a greater number of signal pins than an existing USB connector and are physically larger as well. For example, while the PCI Express is useful for its higher possible data rates, a 26-pin connectors and wider card-like form factor limit the use of Express Cards. For another example, SATA uses two connectors, one 7-pin connector for signals and another 15-pin connector for power. Due to its clumsiness, SATA is more useful for internal storage expansion than for external peripherals.

The existing USB connectors have a small size but low transmission rate, while other non-USB connectors (PCI Express, SATA, et al) have a high transmission rate but large size. Neither of them is desirable to implement modern high-speed, miniaturized electronic devices and peripherals. To provide a kind of connector with a small size and a high transmission rate for portability and high data transmitting efficiency is much desirable. In 2007, led by Intel, a technology named USB 3.0 is developed by Intel, HP, NEC, NXP semiconductor, and TI etc which realize rapid, instant signal transmission.

USB 3.0 is compatible with USB 2.0 very well and adds another set of contacts for high-speed signal transmission based on USB 2.0. The added set of contacts comprises two pairs of differential contacts and a grounding contact located between the two pairs of differential contacts for suppressing cross-talk when high-speed signal transmission. The problem existed at present is how to assemble two sets of contacts to the same insulative housing or how to manufacture an insulative housing capable of containing two sets of contacts because of compact size of current USB 2.0. Usually, for saving space, many manufacturers utilize insert-molding technology to mold one set of contacts together with an insulative housing, and then assemble the other set of contacts to the insulative housing. However, insert-molding technology is relatively expensive, and with relatively high doorsill, it is not beneficial for manufacturers to decrease prices of the electrical connector and improve competition ability thereof.

Thus, it is desirable to achieve an electrical connector with improved contact arrangement to address problems mentioned above.

BRIEF SUMMARY OF THE INVENTION

Accordingly, an object of the present invention is to provide an electrical connector with lower cost and easy to be assembled.

In order to achieve the above-mentioned object, an electrical connector in accordance with the present invention comprises an insulative housing extending in a front-to-back direction and comprising a rear base portion and a front tongue portion, and first and second sets of contacts held in the insulative housing. The first set of contacts comprises at least one pair of differential contacts for transmitting high-speed signals. Each first contact comprises a nonelastic first mating portion occupying a front section of the tongue portion, a first body portion interferentially received in the insulative housing, and a first termination portion extending from the first body portion and extending beyond the base portion. Each of the second set of contacts comprises an elastic second mating portion located behind the nonelastic first mating portion along the front-to-back direction, a second body portion interferentially received in the insulative housing, and a second termination portion extending from the second body portion and beyond the base portion. The first and second sets of contacts are assembled to the insulative housing along opposite directions. The first and second body portions are provided with interference sections thereon to interferentially engage with the insulative housing. The first mating portion of each first contact is provided with interference sections to engage with the tongue portion of the insulative housing.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
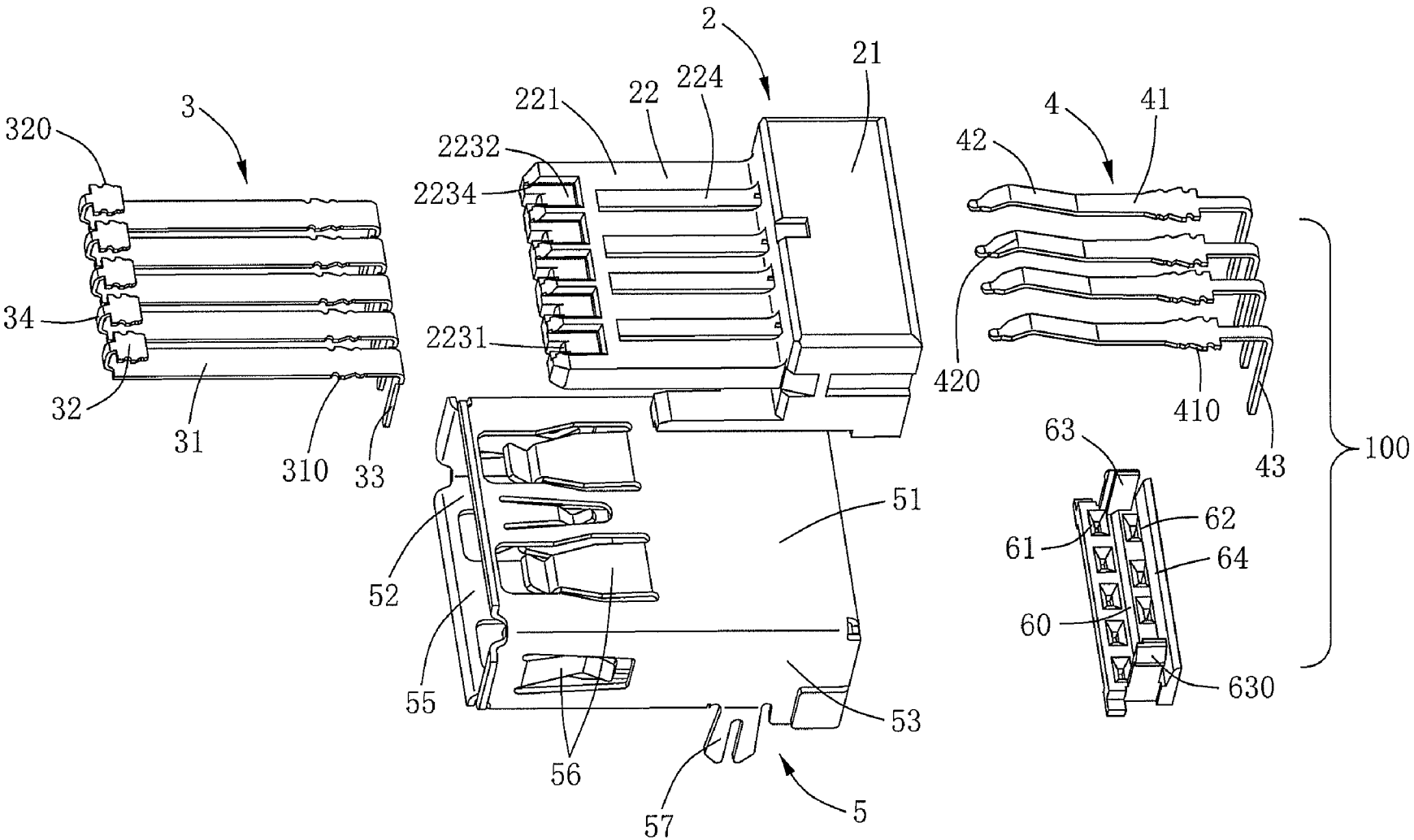
FIG. 1 is an exploded, perspective view of an electrical connector in accordance with the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Within the following description, a standard USB connector, plug, and signaling all refer to the USB architecture described within the Universal Serial Bus Specification, 2.0 Final Draft Revision, Copyright December, 2002, which is hereby incorporated by reference herein. USB is a cable bus that supports data exchange between a host and a wide range of simultaneously accessible peripherals. The bus allows peripherals to be attached, configured, used, and detached while the host and other peripherals are in operation. This is referred to as hot plug.

Figure 2:
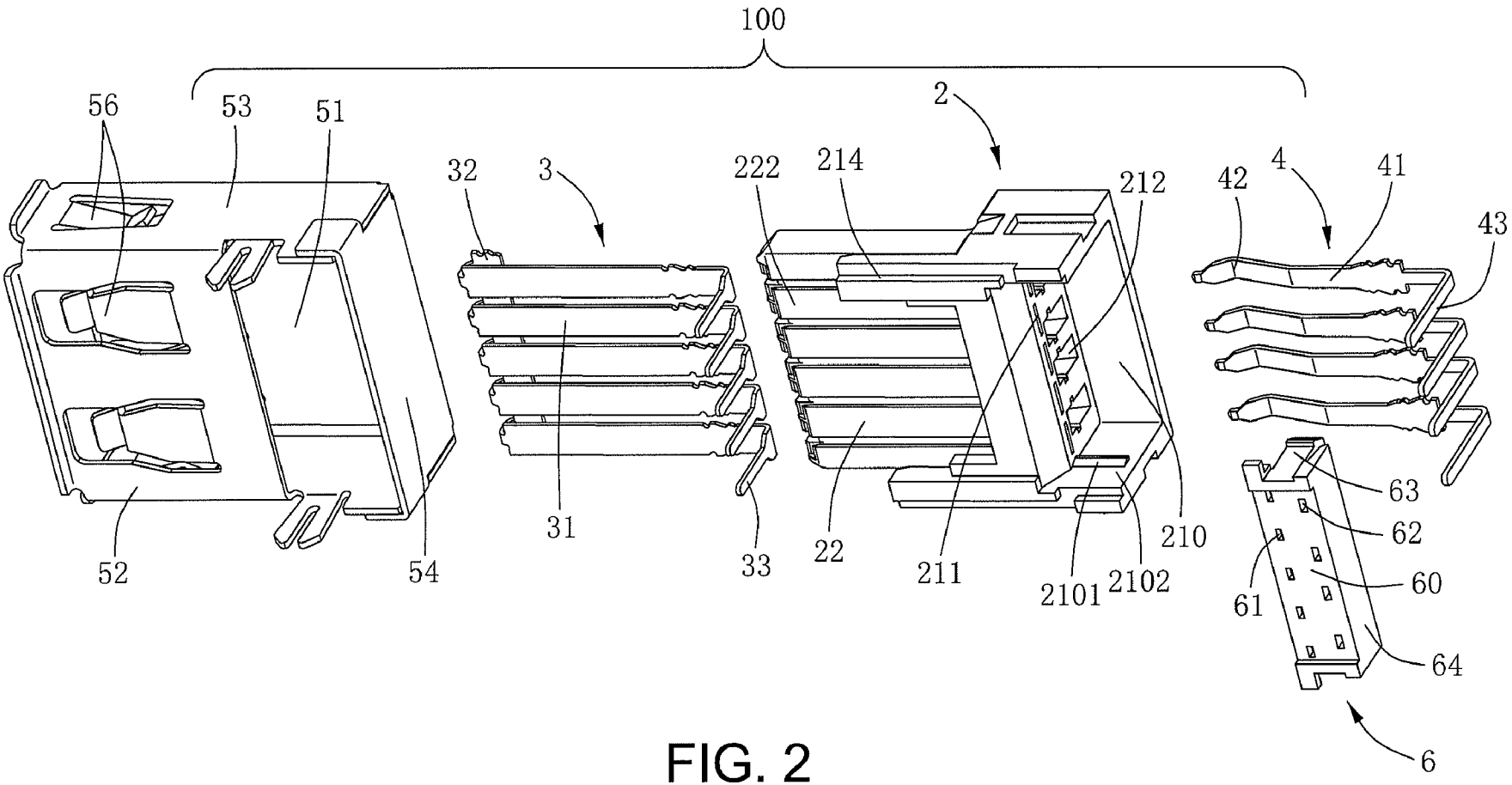
FIG. 2 is a view similar to FIG. 1, but viewed from a different aspect.
Figure 3:
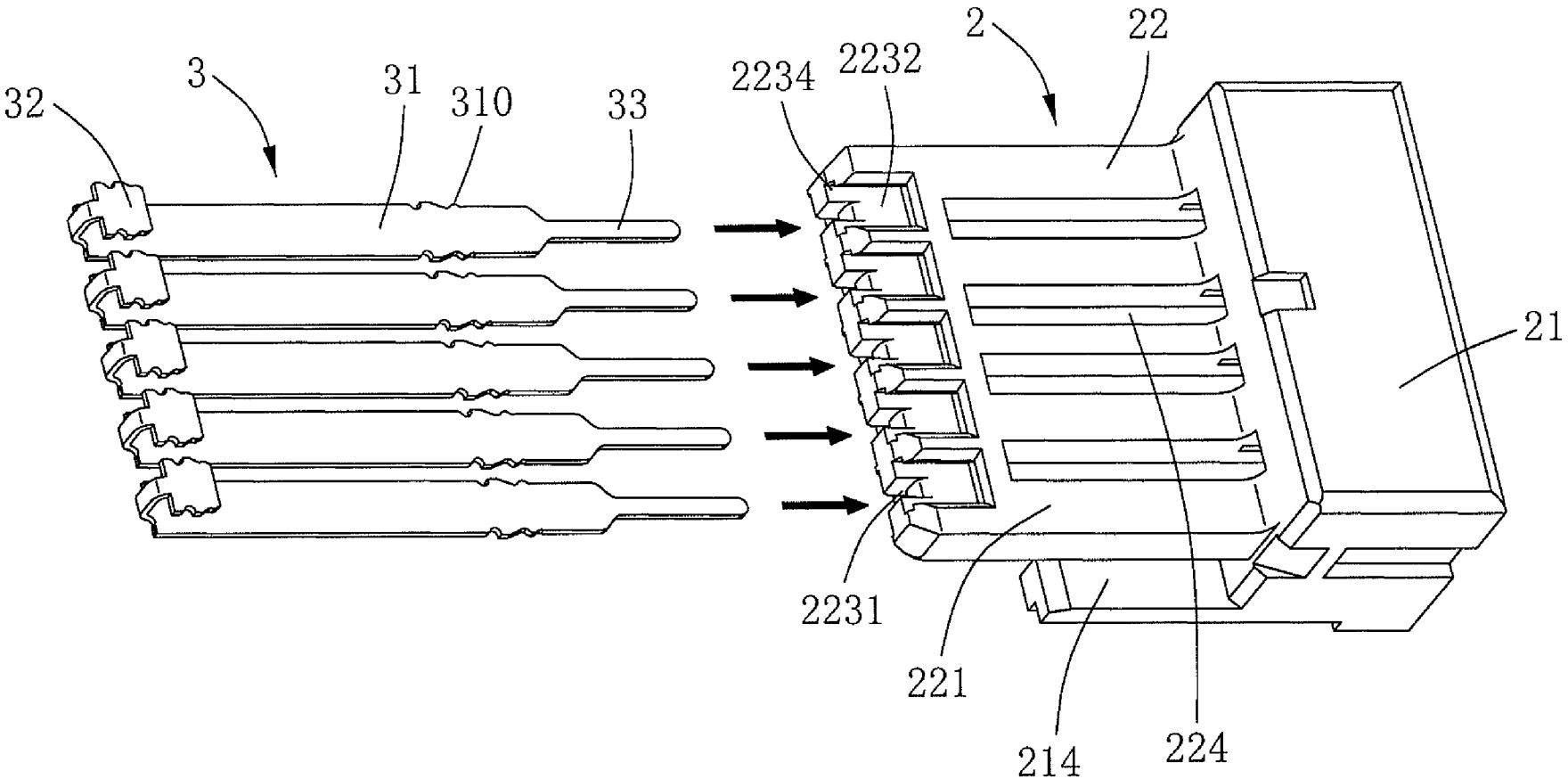
FIG. 3 is an exploded, perspective view of an insulative housing and first set of contacts, which shows the assembled direction therebetween.
Figure 4:
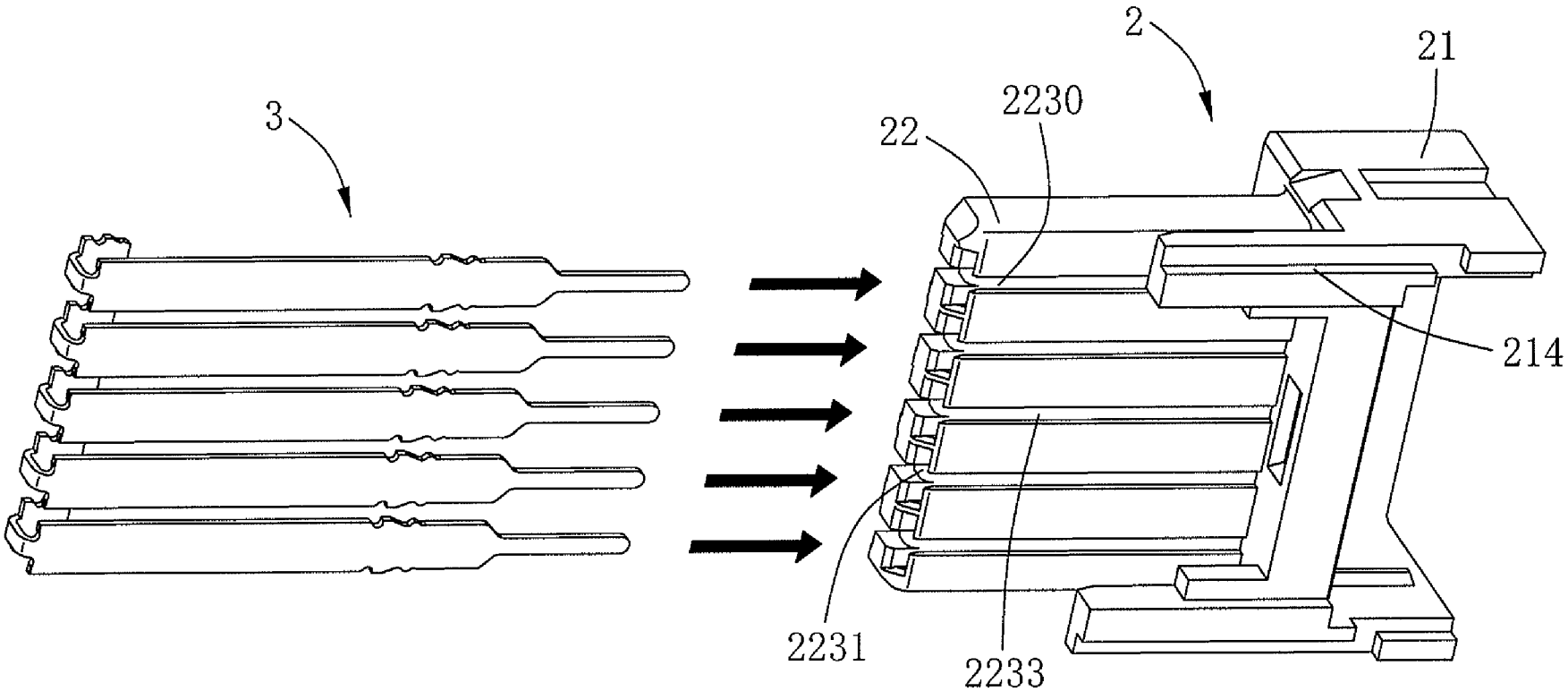
FIG. 4 is a view similar to FIG. 3, but viewed from a different aspect.
Figure 5:
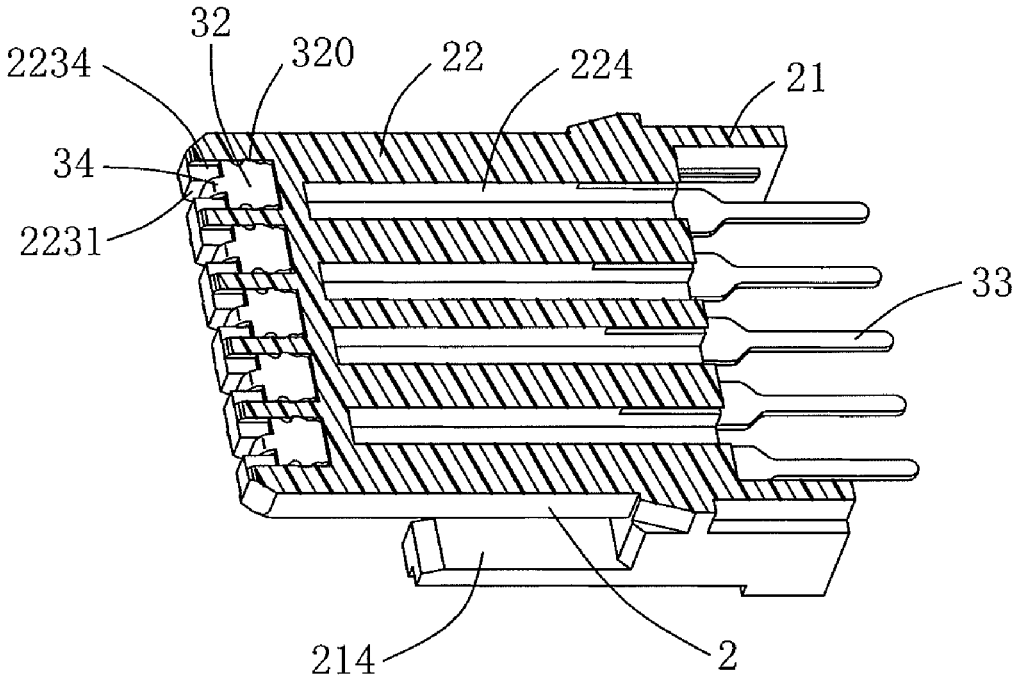
FIG. 5 is a cross-sectional view of assembled structures shown in FIG. 3, which shows how first mating portions of the first set of contacts securely assembled to the insulative housing.
Figure 6:
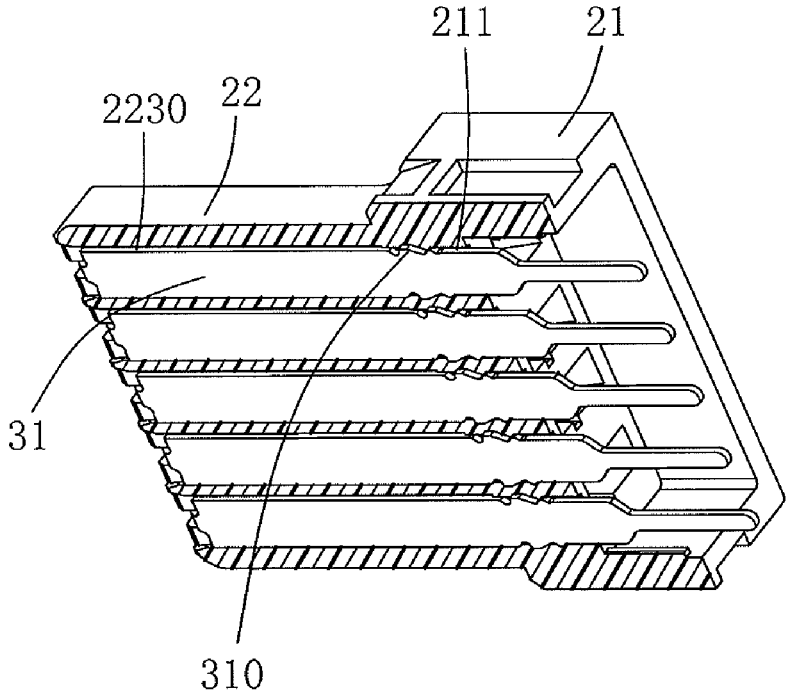
FIG. 6 is a cross-sectional view of assembled structures shown in FIG. 3, which shows how first body portions of the first set of contacts securely assembled to the insulative housing.
Figure 7:
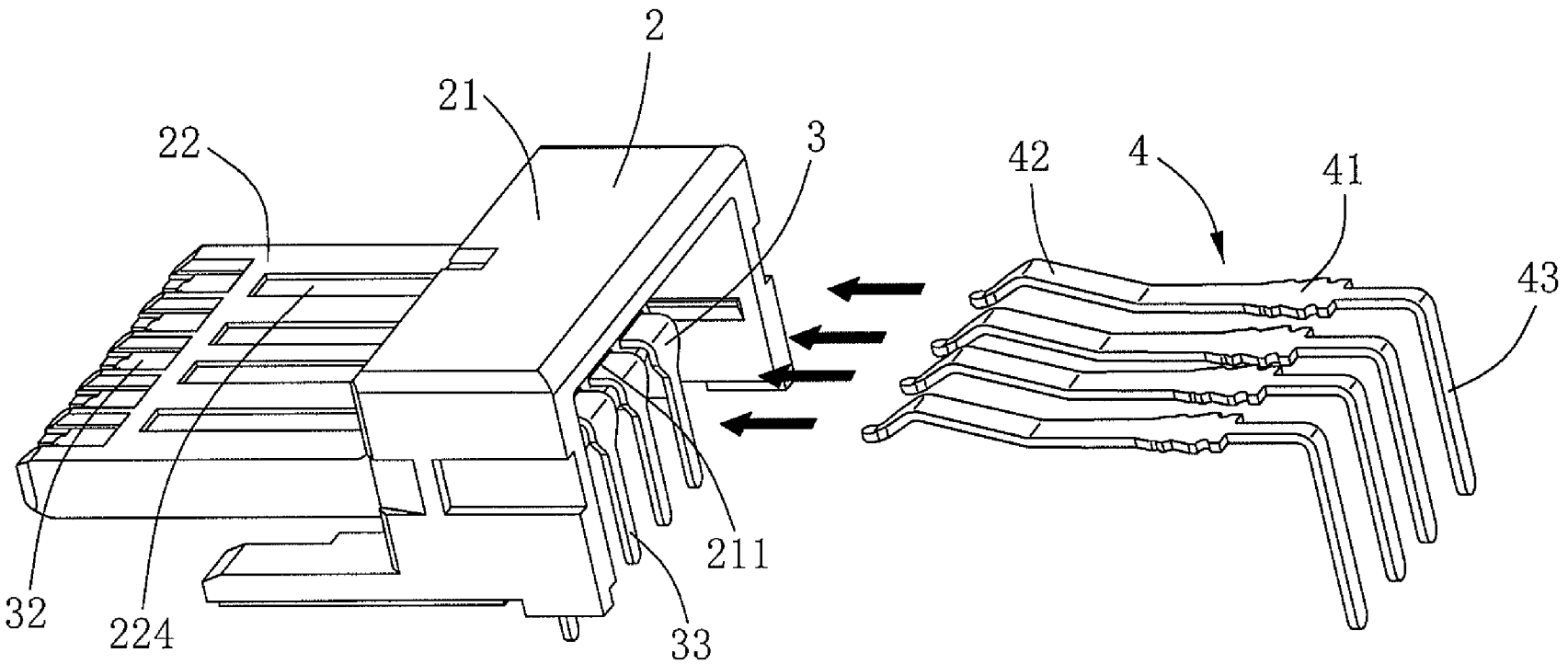
FIG. 7 illustrates the assembled direction of second set of contacts assembled to the insulative housing.

Referring to FIGS. 1-2, an electrical connector 100 according to a preferred embodiment of the present invention is disclosed. The electrical connector 100 comprises an insulative housing 2, a first set of contacts 3 and a second set of contacts 4 supported in the insulative housing 2, and a metal shell 5 enclosing the insulative housing 2 and the contacts 3, 4. Detail description of these elements and their relationship and other elements formed thereon will be detailed below.

Referring to FIGS. 1-4, the insulative housing 2 comprises a rectangular base portion 21 and a tongue portion 22 extending forwardly from a middle of a front surface of the base portion 21. The base portion 21 and the tongue portion 22 of the insulative housing 2 are integrally injecting molded as a unit one piece. The base portion 21 defines a rectangular termination space 210 recessed forwardly from a rear surface thereof, a plurality of first contact-receiving passageways 211 arranged in a lower row, and a plurality of second contact-receiving passageways 212 arranged in an upper row. A U-shape supporting portion 214 extends forwardly from lower section of the front surface of the base portion 21 to locate below the tongue portion 22 for supporting the metal shell 5. The termination space 210 is of U-shape and forms a pair of latch sections 2101 extending along front-to-back direction on a pair of lateral walls 2102 of the base portion 21.

The tongue portion 22 has an upper first supporting surface 221 lower than the upper surface of the base portion 21 and opposite second supporting surface 222. Four second contact-receiving passages 224 are recessed downward from the first supporting surface 221 to communicate with respectively second contact-receiving passageways 212. Five first contact-receiving passages 223 communicate with the first and second supporting surfaces 221, 222 and respective first contact-receiving passages 211. Each first contact-receiving passage 223 is of L-shape and comprises a main section 2230 penetrating through the tongue portion 22 along front-to-back direction, a mating section 2232 recessed downward from the first supporting surface 221, and a connecting section 2231 connecting the mating section 2232 and the main section 2230. The main sections 2230 communicate with the second supporting surface 222 via a plurality of slits 2233. The connecting section 2231 is defined by being recessed rearward from a front surface of the tongue portion 22. A pair of guiding slots 2234 is recessed laterally from a bottom surface of the mating section 2232. The mating sections 2232 and the second contact-receiving passages 224 together occupy the first supporting surface 221, and the second contact-receiving passages 224 occupy majority of the first supporting surface 221.

Figure 11:
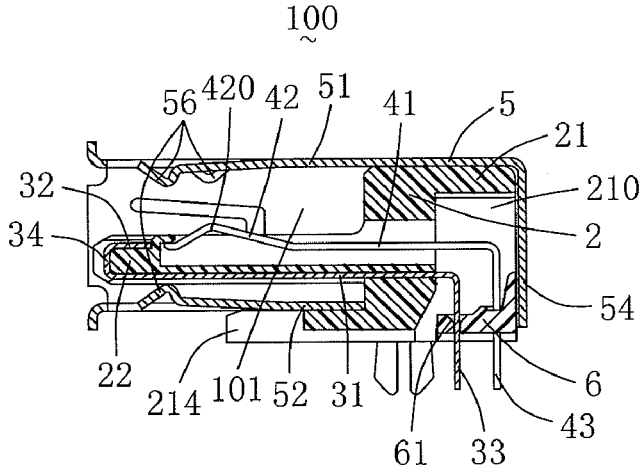
FIG. 11 is a cross-sectional view taken along line 11-11 of FIG. 9.

Referring to FIGS. 1-6 in conjunction with FIG. 11, the first set of contacts 3 includes five conductive contacts and are inserted into the insulative housing 2 along front-to-back direction. Each first contact 3 comprises a first body portion 31 interferentially received in the main section 2230 of the first contact-receiving passage 223 and the first contact-receiving passageways 211, a first mating portion 32 interferentially received in the mating section 2232 of the first contact-receiving passage 223 and parallel to the first body portion 31, a termination portion 33 extending rearward from the first body portion 31 then bent to be received in the termination space 210, and a neck portion 34 connecting the first body portion 31 and the first mating portion 32 in parallel. The neck portion 34 is of U-shape and is received in the connecting section 2231. The first body portion 31 forms a plurality of barbs (interference sections) 310 on opposite lateral edges thereof for interferentially engaging with inner walls of the first contact-receiving passageways 211 to secure the first contact 3 to the insulative housing 2 (particularly to FIG. 6). The first mating portion 32 slides along and guided by the guiding slots 2234 to be received in the mating sections 2232. A plurality of barbs (interference sections) 320 is disposed on opposite lateral edges of the first mating portion 32 for interferentially engaging with the guiding slots 2234. Therefore, the first mating portions 32 are exposed in the mating sections 2232 and located in a surface lower than the first supporting surface 221. The five first contacts 3 comprise two pairs of differential contacts for high-speed signal transmission, and a grounding contact located between the two pairs of differential contacts for suppressing cross-talk. One differential pair is used for receiving signals, and the other differential pair is used for transmitting signals.

Please refer to FIGS. 1-2, 7 and 11, the second set of contacts 4 are assembled to the insulative housing 2 along back-to-front direction. Each second contact 4 comprises a flat second body portion 41 interferentially received in the second contact-receiving passageways 212, a second mating portion 42 extending forwardly from the second body portion 41 and elastically curved upwardly, and a second termination portion 43 extending rearward from the second main portion 41 then bending downwardly. The second body portion 41 forms a plurality of barbs (interference sections) 410 on opposite lateral sides thereof for interferentially engaging with the second contact-receiving passageways 212. The second mating portion 42 is partially received in the second contact-receiving passages 224 with curved contacting section 420 located above the first supporting surface 221 for forming electrical connection with a complementary connector (not shown). The four second contacts 4 comply with USB 2.0 standard, and one is a power contact, two are a pair of positive and negative contacts, and one is a grounding contact in turn.

Figure 8:
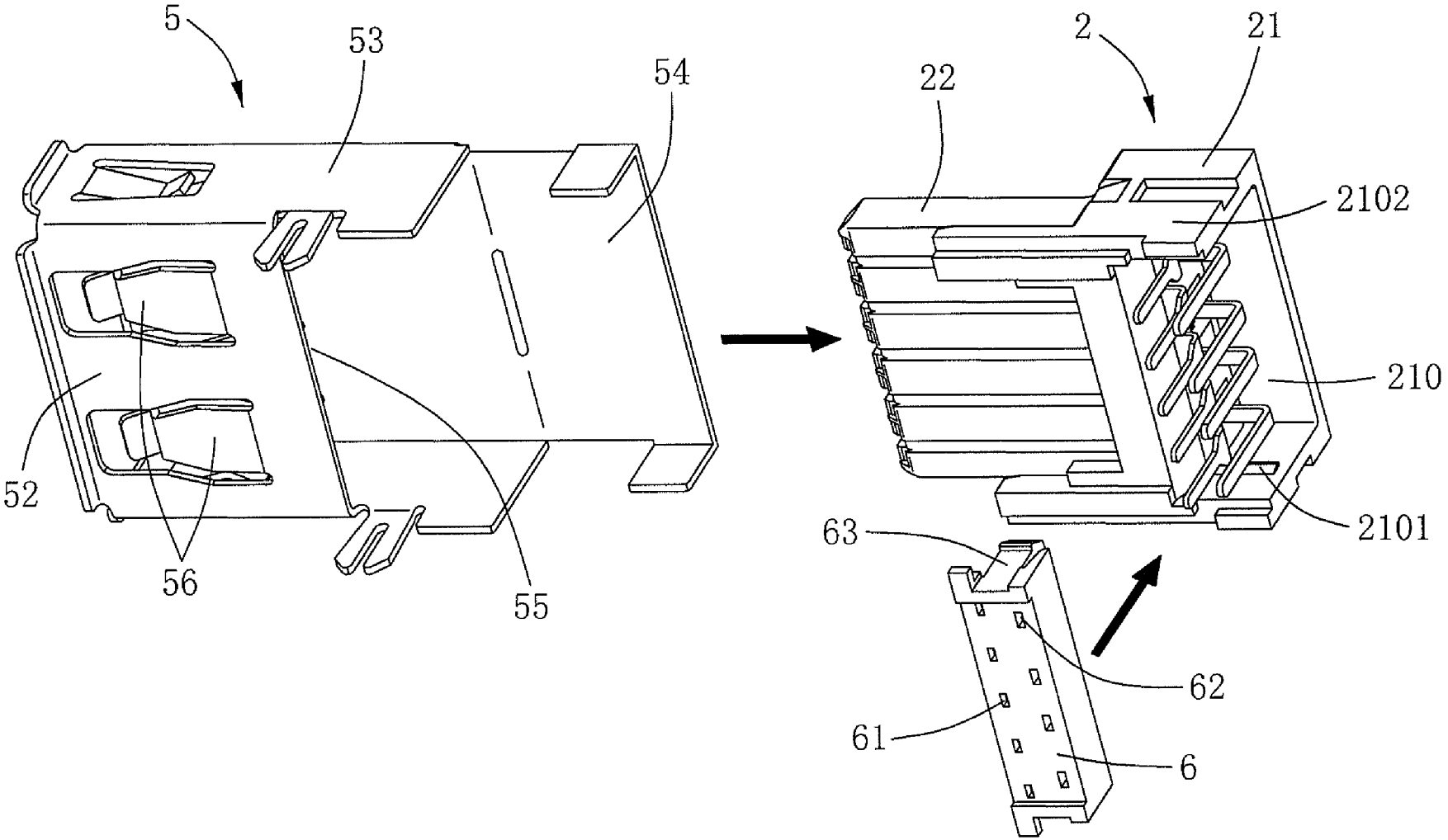
FIG. 8 is a partially assembled view of FIG. 2, wherein the first and second sets of contacts both are assembled to the insulative housing.
Figure 9:
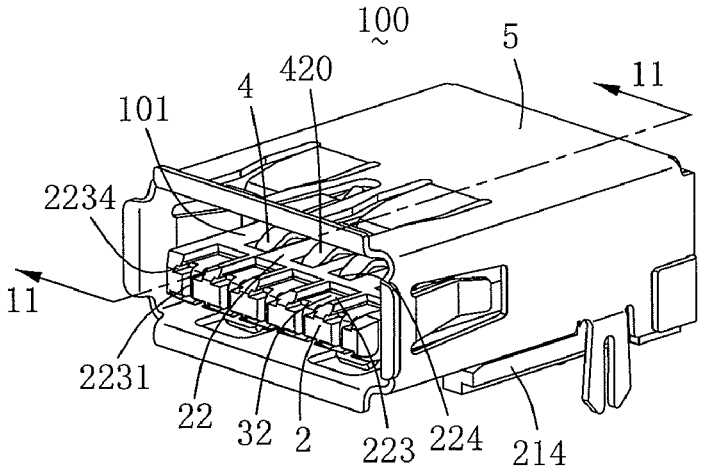
FIG. 9 is an assembled, perspective view of the electrical connector in accordance with the present invention.
Figure 10:
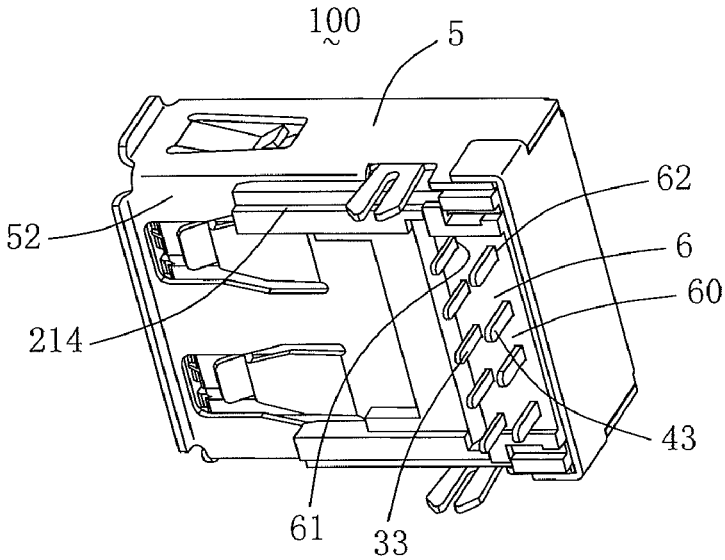
FIG. 10 is a view similar to FIG. 9, but viewed from a different aspect.

Please refer to FIGS. 1-2 in combination with FIGS. 9-11, the shell 5 is stamped from a metal sheet and comprises a rectangular receiving space 55 circumscribed by opposite upper and lower walls 51, 52, opposite left and right lateral walls 53 and a rear wall 54. The insulative housing 2 is received in the receiving space 55 of the shell 5 with the upper wall 51 forming a mating space 101 together with the first supporting surface 221 for receiving the complementary connector to form electrical connection with the first and second sets of contacts 3, 4. Except the rear wall 54, each wall of the shell 5 is formed with a plurality of elastic fingers 56 for elastically abutting against a metal shell of the complementary connector to form shielding protection. Please refer to FIGS. 8 and 10, the shell 5 is assembled to the insulative housing 2 along the front-to-back direction with the lower wall 52 supported by the supporting portion 214 and the rear wall 54 being bent downwardly to seal the termination space 210. Each lateral wall 53 is formed with a board-lock 57 extending downwardly therefrom for locking with a printed circuit board to which the electrical connector 100 is mounted.

Referring to FIGS. 1-2 in conjunction with FIGS. 8 and 10-11, the electrical connector 100 in accordance with the present invention also comprises a spacer 6 which is assembled to the insulative housing 2 along down-to-up direction to latch with the insulative housing 2 for aligning the terminating portions 33, 43 of the first and second sets of contacts 3, 4. The spacer 6 comprises a main body 60 defining five first retaining holes 61 and four second retaining holes 62, a pair of latch sections 63 extending upwardly from opposite lateral sides of the main body 60, and a block portion 64 extending upwardly from a rear edge of the main body 60. When the spacer 6 is assembled to be received in the termination space 210 of the insulative housing 2, latches 630 formed at free ends of the latch sections 63 latch with the latch sections 2101 to secure the spacer 6. The termination portions 33, 43 of the contacts 3, 4 respectively protrude through the first and second retaining holes 61, 62 then electrically connect to the printed circuit board.

It is no need to utilize high-technology to manufacture the first and second sets of contacts 3, 4 and the insulative housing 2 of the present invention. Current molds can satisfy the manufacture needs. The non-elastic first mating portions 32 of the first contacts 3 can be stamped then bent to form, and because of the existence of the barbs, the first contacts 3 are capable of combine with the insulative housing 2 tightly after the first contacts 3 insert into a certain depth to the insulative housing 2. In addition, the mating portions 31, 41 of the contacts 3, 4 all are located at the same side of the insulative housing 2 that is the first supporting surface 221. But, in an alternative embodiment, the mating portions 31, 41 can be arranged to be located at different sides of the insulative housing 2 that is the first and second supporting surfaces 221, 222.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. An electrical connector, comprising:

an insulative housing extending in a front-to-back direction and comprising a rear base portion and a front tongue portion; and a first set of contacts held in the insulative housing and comprising at least one pair of differential contacts for transmitting high-speed signals, each first contact comprising a nonelastic first mating portion occupying a front section of the tongue portion, a first body portion interferentially received in the insulative housing, and a first termination portion extending from the first body portion and extending beyond the base portion;

a second set of contacts held in the insulative housing, and each of the second set of contacts comprising an elastic second mating portion located behind the nonelastic first mating portion along the front-to-back direction, a second body portion interferentially received in the insulative housing, and a second termination portion extending from the second body portion and beyond the base portion; and wherein the first and second sets of contacts are assembled to the insulative housing along opposite directions, the first and second body portions are provided with interference sections thereon to interferentially engage with the insulative housing, and the first mating portion of each first contact is provided with an interference section to engage with the tongue portion of the insulative housing.

2. The electrical connector as claimed in claim 1, wherein the first mating portion is parallel to the first body portion of the first contact, and wherein the first mating portion and the first body portion are respectively located at different sides of the tongue portion of the insulative housing.

3. The electrical connector as claimed in claim 1, wherein the tongue portion defines at least a pair of first contact-receiving passageways, the base portion defines at least a pair of first contact-receiving passages respectively communicating with the first contact-receiving passageways, and wherein the first body portion is received in both the first contact-receiving passageway and the first contact-receiving passage.

4. The electrical connector as claimed in claim 3, wherein the interference sections of the first body portion interferentially engage with the first contact-receiving passage.

5. The electrical connector as claimed in claim 3, wherein the first contact-receiving passageway comprises a main section in which the first body portion is partially received, a mating section recessed downward from the tongue portion in which the first mating portion is received, and wherein the interference sections of the first mating portion interferentially engage with the mating section of the tongue portion.

6. The electrical connector as claimed in claim 5, wherein the mating section defines a pair of guiding slots extending laterally therefrom, and wherein the first mating portion is guided by the guiding slots to insert into the mating section and the interference sections thereof interferentially engaging with the guiding slots.

7. The electrical connector as claimed in claim 5, wherein the first contact-receiving passageway comprises a connecting section connecting the upper mating section and lower main section, and wherein the first contact comprises a connecting portion received in the connecting section and connecting the first mating portion and the first body portion.

8. The electrical connector as claimed in claim 1, wherein the tongue portion comprises parallel first and second supporting surfaces, and wherein the first mating portions of the first contacts locate in a surface lower than the first supporting surface, and the second mating portions of the second contacts are partially exposed beyond the first supporting surface.

9. The electrical connector as claimed in claim 1, wherein the geometric profile of the tongue portion is substantially same as that of a standard type-A USB 2.0 plug.

10. The electrical connector as claimed in claim 1, wherein the elastic second mating portions of the second set of contacts occupy a majority of length of the tongue portion along front-to-back direction with respect to that of the nonelastic first mating portions of the first set of contacts.

11. The electrical connector as claimed in claim 1, wherein the second set of contacts is adapted for USB protocol and an arrangement of the second set of contacts is compatible to a standard USB receptacle, and wherein the pair of differential contacts is adapted for non-USB protocol.

12. The electrical connector as claimed in claim 1, further comprising a shell enclosing the insulative housing, and wherein a mating space is defined by the shell and the tongue portion of the insulative housing, and the first and second mating portions of the first and second sets of contacts are exposed into the mating space.

13. The electrical connector as claimed in claim 1, further comprising a spacer assembled to the base portion of the insulative housing, and wherein the first and second termination portions of the first and second sets of contacts are aligned by the spacer.

14. The electrical connector as claimed in claim 13, wherein the spacer defines at least a pair of first retaining holes with the first termination portions of the first set of contacts protruding therethrough, and a plurality of second retaining holes with the second termination portions of the second set of contacts protruding therethrough.

15. The electrical connector as claimed in claim 13, wherein the spacer forms a pair of latch sections at opposite lateral sides thereof to latch with the base portion of the insulative housing.

* * * * *